US009557146B2

(12) United States Patent
Bradley et al.

(10) Patent No.: US 9,557,146 B2
(45) Date of Patent: Jan. 31, 2017

(54) WIRE NEUTRALIZATION SYSTEM

(71) Applicant: MICHIGAN TECHNOLOGICAL UNIVERSITY, Houghton, MI (US)

(72) Inventors: Scott A. Bradley, Chassell, MI (US); Jason M. Wiitanen, Painesdale, MI (US); Timothy B. Smigowski, Chassell, MI (US); John T. Niemeyer, Ray, MI (US); Andrew Culkin, Washington, MI (US)

(73) Assignees: MICHIGAN TECHNOLOGICAL UNIVERSITY, Houghton, MI (US); THE U.S. ARMY TANK AUTOMOTIVE RESEARCH, DEVELOPMENT AND ENGINEERING CENTER (TARDEC), Warren, MI (US)

( * ) Notice: Subject to any disclaimer, the term of this patent is extended or adjusted under 35 U.S.C. 154(b) by 199 days.

(21) Appl. No.: 14/302,170

(22) Filed: Jun. 11, 2014

(65) Prior Publication Data

US 2015/0362295 A1 Dec. 17, 2015

(51) Int. Cl.
*F41H 11/24* (2011.01)
*F41H 11/30* (2011.01)

(52) U.S. Cl.
CPC ..... *F41H 11/30* (2013.01); *F41H 11/24* (2013.01)

(58) Field of Classification Search
CPC ..... F41H 5/0471; F41H 5/04; F41H 5/0414; F41H 5/0428; F41H 5/0442; F41H 5/0457; F41H 5/0478; A01B 13/08; A01B 15/025; A01B 43/00; A01B 39/18; E02F 5/32; E02F 5/102; E02F 9/2875
USPC ..... 89/1.13; 102/402, 403; 172/699, 701; 171/22, 62, 64, 70
See application file for complete search history.

(56) References Cited

U.S. PATENT DOCUMENTS 33,877 A * 12/1861 Chateau ..... A01B 13/025 172/480
2,091,427 A * 8/1937 Brodersen ..... A01B 63/14 172/413
2,093,125 A * 9/1937 Davenport ..... E01C 23/121 172/398
2,100,856 A * 11/1937 Killefer ..... E01C 23/121 172/237
3,771,413 A * 11/1973 Sieg ..... F41H 11/30 89/1.13
3,960,220 A * 6/1976 Laitala ..... A01B 61/046 172/261
4,467,694 A * 8/1984 Azulai ..... E02F 3/7613 171/141

(Continued)

FOREIGN PATENT DOCUMENTS

FR EP 2397808 A1 * 12/2011 ..... F41H 11/20

*Primary Examiner* — Jonathan C Weber
(74) *Attorney, Agent, or Firm* — Michael Best & Friedrich LLP

(57) ABSTRACT

A wire neutralizing system for use with a vehicle including a frame adapted to be hitched to a vehicle. At least one wheel supports the frame while a bottom of the wheel rolls over terrain having buried wires. The system also includes a blade movable between a stowed position in which the blade is above the bottom of the wheel and a deployed position in which the blade is below the bottom of the wheel, such that the blade plows through the terrain to disable buried wires when in the deployed position.

10 Claims, 10 Drawing Sheets

(56) References Cited

U.S. PATENT DOCUMENTS

| | | | | |
|---|---|---|---|---|
| 4,491,053 | A * | 1/1985 | Bar-Nefy | E02F 3/7613 171/141 |
| 4,552,053 | A * | 11/1985 | Bar-Nefy | F41H 11/24 171/141 |
| 4,690,030 | A * | 9/1987 | Bar-Nefy | E02F 3/76 171/141 |
| 8,490,531 | B2 | 7/2013 | Simula et al. | |
| 8,522,661 | B2 * | 9/2013 | Hembise | F41H 11/16 102/402 |
| 2006/0266576 | A1 * | 11/2006 | Eckhoff | B62D 49/0635 180/14.1 |
| 2011/0232468 | A1 * | 9/2011 | Hembise | F41H 11/16 89/1.13 |
| 2011/0296976 | A1 * | 12/2011 | Simula | F41H 11/30 89/1.13 |
| 2015/0268012 | A1 * | 9/2015 | Cronk | F41H 11/18 89/1.13 |

* cited by examiner

WIRE NEUTRALIZATION SYSTEM

STATEMENT REGARDING FEDERALLY SPONSORED RESEARCH OR DEVELOPMENT

This invention was made with government support under contract number W56HZV-08-C-0525 awarded by the U.S. Army Tank Automotive Research, Development and Engineering Center. The United States government has certain rights in the invention.

BACKGROUND

The present invention relates to a wire neutralization system, and more specifically to a wire neutralization system for buried wires used to detonate explosive devices.

Military convoys occasionally travel through areas which may have explosive devices. These explosive devices may be triggered by a target presence sensor, a timer, or by a user controlled detonator. Examples of target presence sensors are trip wires, pressure plates, tilt sensors, and motion detectors, all of which infer the presence of a target from an input signal and automatically send a detonation signal, often through a control wire, to detonate the explosive device. Timers detonate an explosive device, usually by sending a detonation signal through a control wire, at a preselected time or within a preselected passage of time from a start time. User controlled detonators are operated by a human operator and may send the detonation signal via a control wire connected to the explosive device. The present invention is concerned with any type of explosive device that uses a buried wire of any kind to transmit a detonation signal or otherwise trigger the detonation of the explosive device. The buried wire may be buried in the terrain to mask the presence of the explosive device.

It would be useful to have a wire neutralization system that could neutralize buried wires. It would further be useful to be able to operate such a wire neutralization system while driving a vehicle designed to protect a driver from explosions. Such a vehicle could, for example, lead a military convoy to reduce the likelihood that the personnel and contents of the convoy will be harmed by an explosive device that uses a buried wire.

SUMMARY

In one aspect, the invention provides a wire neutralizing system for use with a vehicle, the wire neutralization system comprising: a frame adapted to be hitched to the vehicle; at least one wheel supporting the frame, a bottom of the wheel rolling over terrain having buried wires; and a blade movable between a stowed position in which the blade is above the bottom of the wheel and a deployed position in which the blade is below the bottom of the wheel; wherein the blade plows through the terrain to disable the buried wires when in the deployed position.

In some aspects of the invention, the wire neutralization system further comprises a wheel suspension unit permitting vertical travel of the wheel with respect to the frame in response to rough terrain. In some aspects of the invention, the wire neutralization system further comprises a suspension lockout feature that prevents relative vertical travel of the wheel with respect to the frame while the blade is deployed. In some aspects of the invention, the wire neutralization system further comprises a hydraulic system for moving the blade between the stowed and deployed positions. In some aspects of the invention, the blade comprises a plurality of blades; the wire neutralization system further comprising a hydraulic system for simultaneously moving the plurality of blades between the stowed and deployed positions. In some aspects of the invention, the wire neutralization system further comprises a blade trip biasing member biasing the blade toward the deployed position and accommodating movement of the blade toward a tripped position upon the blade meeting a tripping resistance while in the deployed position. In some aspects of the invention, the wire neutralization system further comprises a blade lift biasing member biasing the blade toward the deployed position and accommodating movement of the blade toward a lifted position upon the blade meeting a lifting resistance while in the deployed position.

In some aspects of the invention, the wire neutralization system further comprises a blade plate moveable mounted to the frame; and a blade station attached to the blade plate, the blade station including: a blade arm mounted to the blade plate; and a blade holder mounted to the blade arm and supporting the blade. In some aspects of the invention, the blade is movable between the stowed position and the deployed position by moving the blade plate with respect to the frame. In some aspects of the invention, the blade plate is pivotably interconnected to the frame and the blade arm is pivotably interconnected to the blade plate such that the blade moves between the stowed and deployed positions in response to the blade plate being pivoted relative to the frame. In some aspects of the invention, the blade plate further includes a blade station mounting tab to mount the blade station to the blade plate.

In another aspect, the invention provides a wire neutralizing system for use with a vehicle, the wire neutralization system comprising: a frame adapted to be hitched to the vehicle; at least one wheel supporting the frame, a bottom of the wheel rolling over terrain having buried wires; a blade plate movably mounted to the frame; and a blade station attached to the blade plate including: an blade arm mounted to the blade plate; a blade holder mounted to the blade arm; and a blade supported by the blade holder; wherein the blade is movable between a stowed position in which the blade is above the bottom of the wheel and a deployed position in which the blade is below the bottom of the wheel by moving the blade plate with respect to the frame; wherein the blade plows through the terrain to disable the buried wires when in the deployed position.

In some aspects of the invention, the wire neutralization system further comprises a wheel suspension unit permitting vertical travel of the wheel with respect to the frame in response to rough terrain; and a suspension lockout feature that prevents relative vertical travel of the wheel with respect to the frame while the blade is deployed. In some aspects of the invention, the suspension lockout feature includes a lockout engagement groove, the lockout engagement groove engageable by the blade plate such that a force pathway is created between the wheel and the frame through the blade plate. In some aspects of the invention, the blade plate is movable relative to the frame via a hydraulic system. In some aspects of the invention, the blade plate is pivotably interconnected to the frame and the blade arm is pivotably interconnected to the blade plate such that the blade moves between the stowed and deployed positions in response to the blade plate being pivoted relative to the frame.

In some aspects of the invention, the blade plate includes a blade station mounting tab to mount the blade station to the blade plate. In some aspects of the invention, the wire neutralization system further comprises a blade lift biasing member connected to the blade station mounting tab and the blade arm to bias the blade toward the deployed position and accommodating movement of the blade toward a lifted position upon the blade meeting a lifting resistance while in the deployed position. In some aspects of the invention, the blade arm includes a stop member that engages a portion of the blade station mounting tab to prevent further movement of the blade while in the lifted position.

In some aspects of the invention, the wire neutralization system further comprises a blade trip biasing member connected to the blade holder and the blade arm to bias the blade toward the deployed position and accommodating movement of the blade toward a tripped position upon the blade meeting a tripping resistance while in the deployed position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
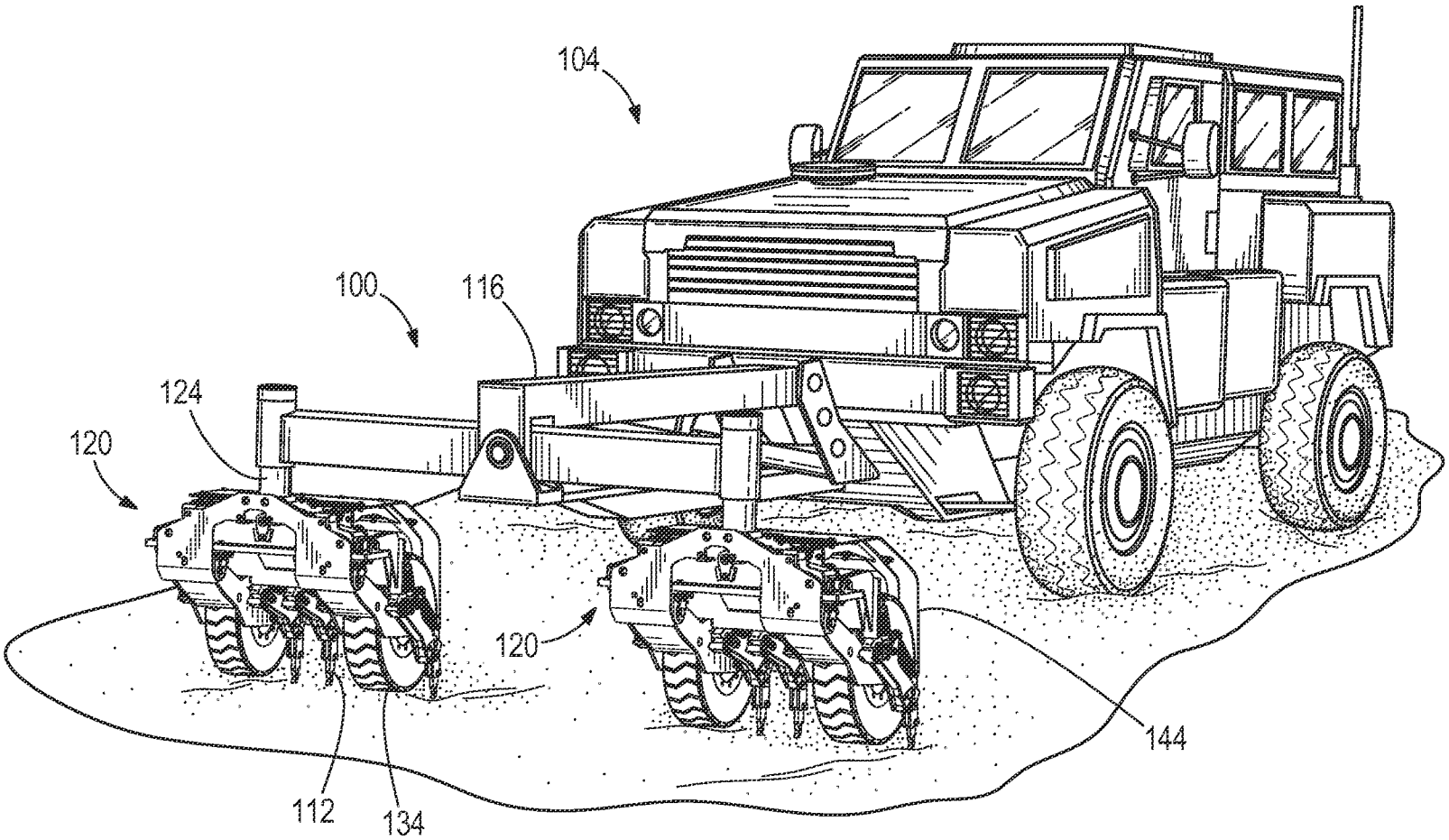
FIG. 1 is a perspective view of a wire neutralization system of the present invention attached to a military vehicle.

FIG. 1 illustrates a wire neutralization system 100 configured to be attached to a vehicle 104. Generally, the wire neutralization system 100 is configured to roll over rough terrain that may contain buried wires 108 (FIG. 7) attaching one or more explosive devices to a respective detonator. The term "wire" refers to any wire of any kind that can transmit a detonation signal or otherwise trigger the detonation of the explosive device. The system 100 is attached to the front of the vehicle 104, such that as the vehicle 104 is driven over the terrain, the system 100 is pushed along the terrain in front of the vehicle 104. Alternative, the system 100 may be pulled along the terrain by the vehicle 104 (e.g., towed behind the vehicle 104). The wire neutralization system 100 includes one or more blades 112 that may be deployed into the ground to plow through the terrain and neutralize the buried wires 108. The term "neutralize" and its variants will be used herein to mean uprooting, cutting, or otherwise deactivating or rendering inoperable a wire for its intended purpose, and to mean exposing a wire or a portion of a wire to make the wire more easily detectable. In the illustrated embodiment, the vehicle 104 is a military vehicle 104 designed to protect a user or driver from harm in the event that a close proximity explosion is triggered while neutralizing the wires 108 coupled to any explosive devices. Alternatively, other vehicles 104 that are sufficient for a desired application may be used in conjunction with the wire neutralization system 100.

The wire neutralization system 100 includes an attachment base 116 that hitches one or more bank assemblies 120 to the front of the vehicle 104. Each of the bank assemblies 120 attaches to the base 116 via a caster pin 124. The bank assemblies 120 are able to freely rotate about the caster pins 124 with respect to the base 116, such that bank assemblies 120 are able to pivot in the desired direction when the vehicle 104 turns or the landscape slopes. Additionally, the attachment base 116 and the bank assemblies 120 each have a rolling degree of freedom that allows for rotation about a horizontal axis. The rolling degree of freedom allows the system 100 to balance or adjust to laterally undulating terrain.

Figure 2:
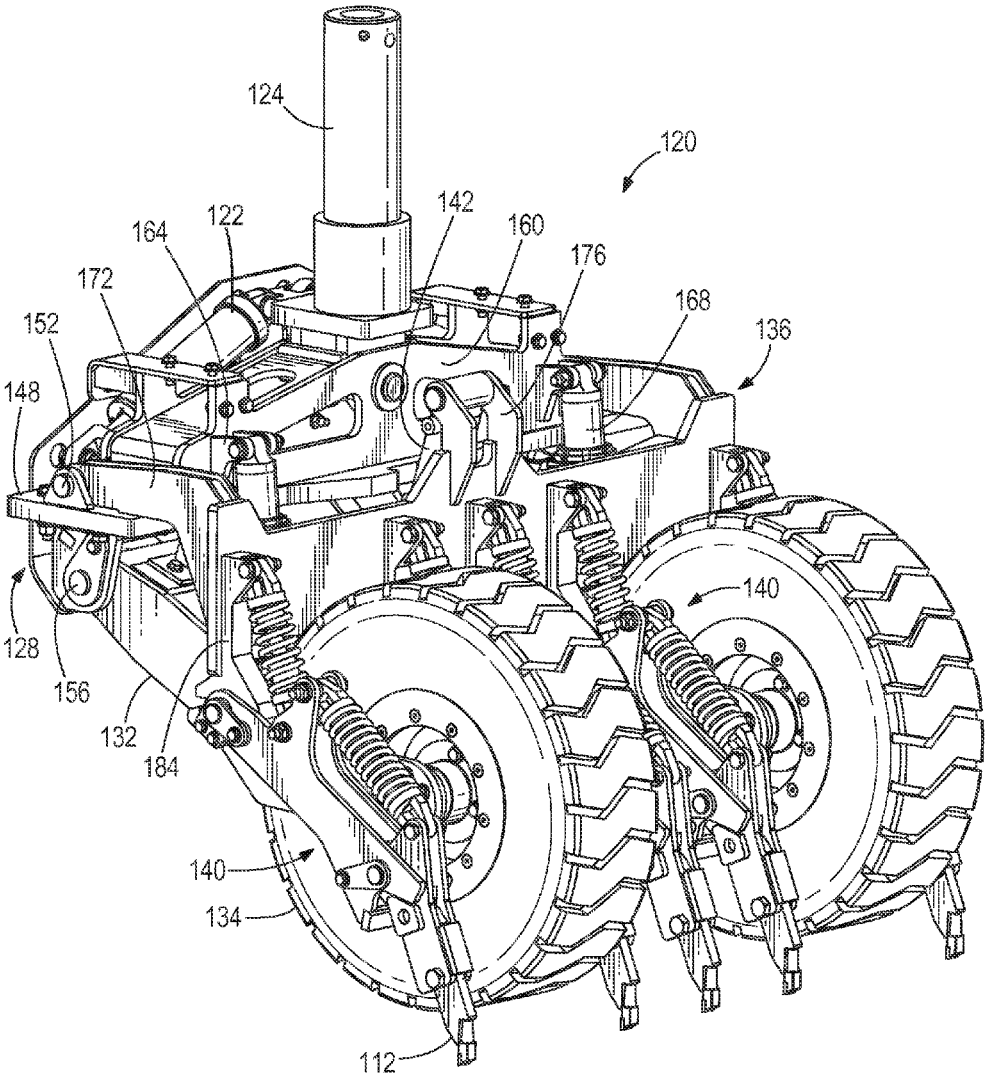
FIG. 2 is a rear perspective view of a bank assembly from the wire neutralization system of FIG. 1.
Figure 3:
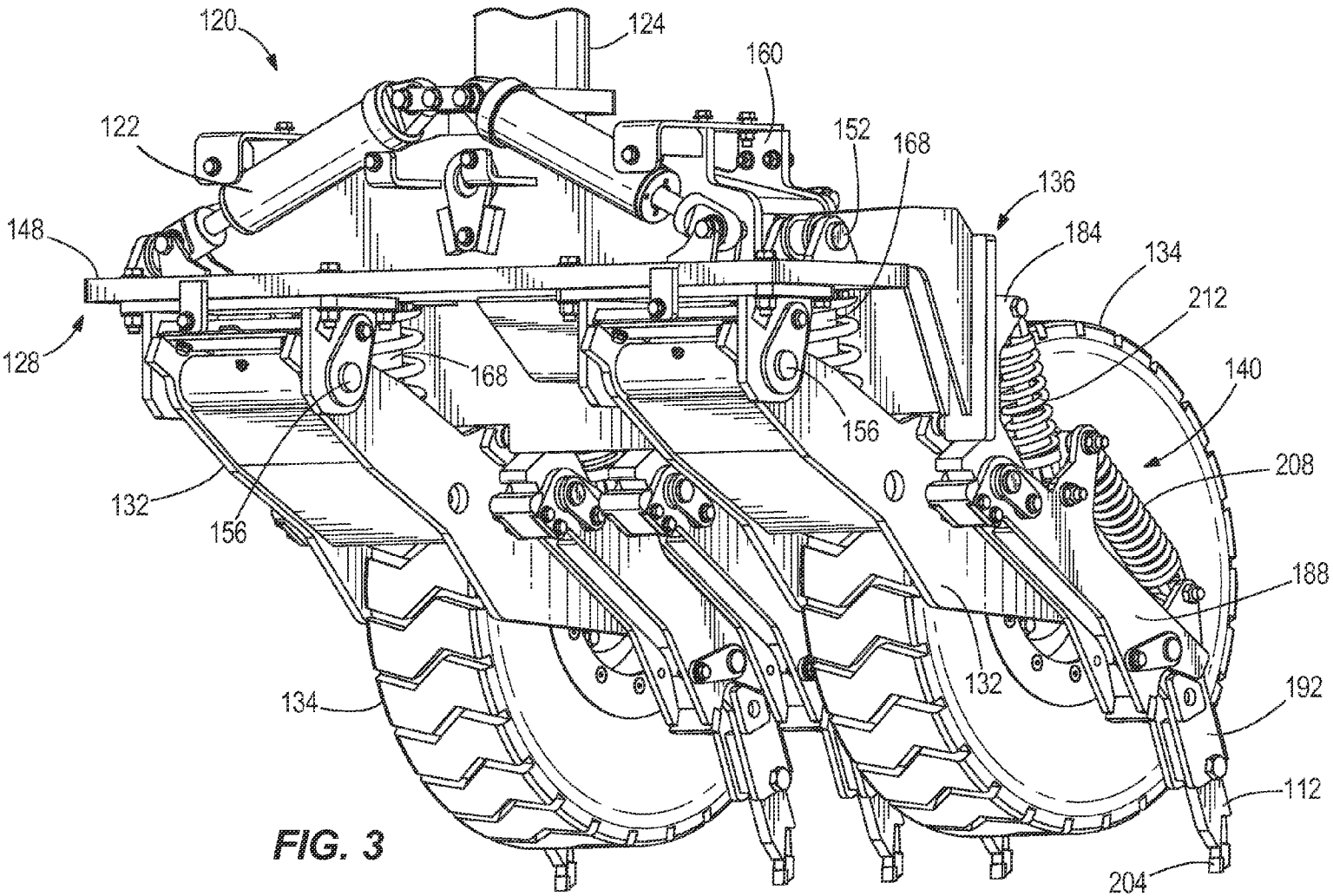
FIG. 3 is a front perspective view of the bank assembly of FIG. 2.
Figure 4:
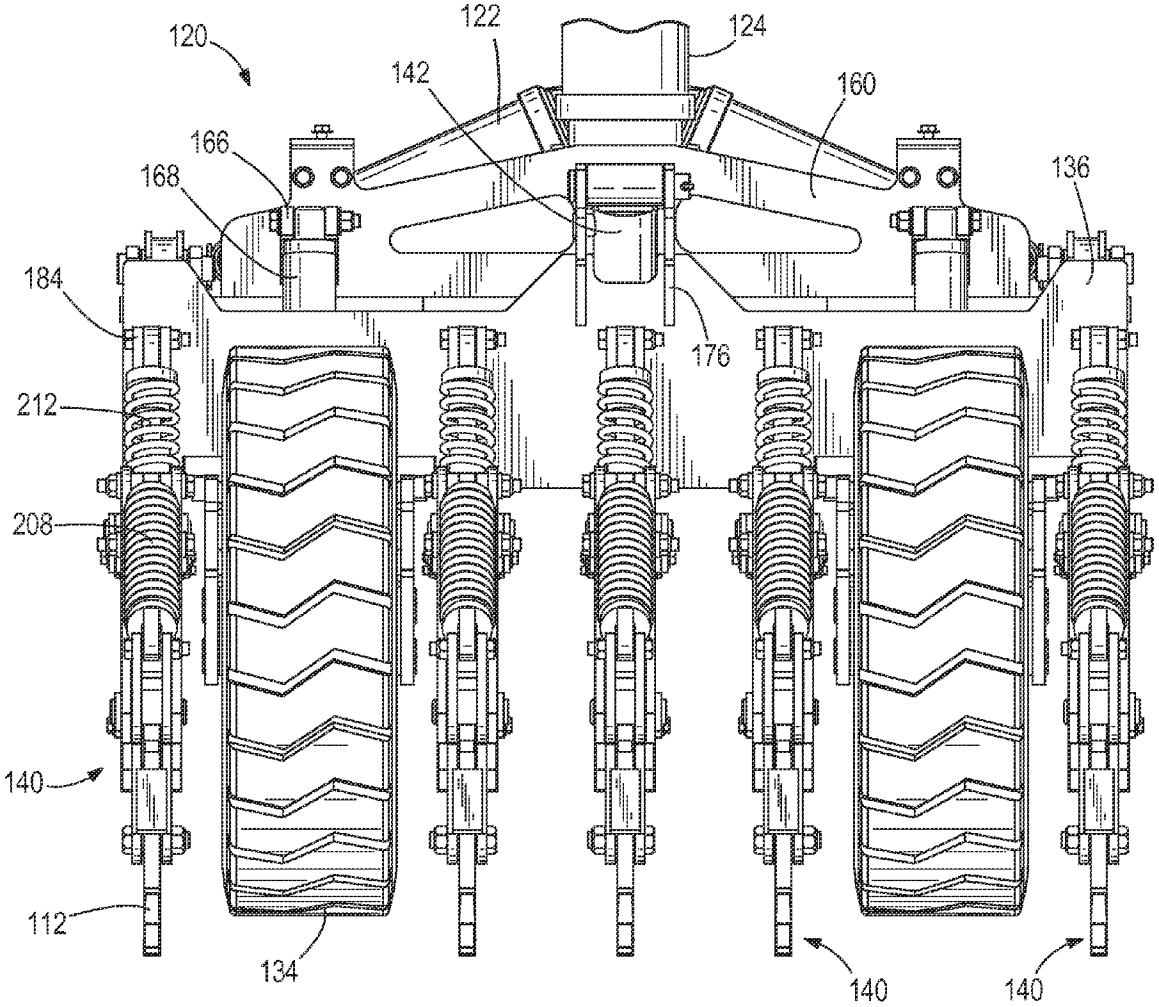
FIG. 4 is a rear view of the bank assembly of FIG. 2 without a cover plate.

FIGS. 2-4 illustrate one bank assembly 120 according to an embodiment of the present invention. The illustrated bank assembly 120 includes a bank frame 128, a plurality of trailing arms 132 supporting one or more wheels 134, a blade plate 136, and one more blade stations 140 attached to the blade plate 136. The bank assembly 120 also includes a plurality of bank roll shocks 122, which may stabilize bank flutter at high speeds (e.g., speed greater than 20 mph). In the illustrated embodiment, the bank assembly 120 includes two trailing arms 132 and two wheels 134, but in alternative constructions the bank assembly 120 may include more or fewer than two trailing arms 132 and wheels 134. The blade plate 136 is moved relative to the bank frame 128 by hydraulically moving or operating a hydraulic actuator 142 (i.e., extending and retracting the actuator's piston relative to its cylinder) attached to both the blade plate 136 and the bank frame 128. As a result, the blade stations 140 are also moved relative to the bank frame 128 when the hydraulic actuator 142 is moved. The bank assembly 120 also includes a cover 144 (FIG. 1) attached to the bank frame 128 that prevents dirt and debris being kicked-up from the wheels 134 from obscuring the view of the vehicle operator. Additionally, the cover 144 (FIG. 1) may also be formed of a material that helps protect the driver from harm in the event of a triggered explosion.

The bank frame 128 of the bank assembly 120 includes a substantially planar bank plate 148 supporting a plurality of blade plate pivot mounts 152 (FIGS. 2 and 3) on a top surface and a plurality of trailing arm mounts 156 (FIGS. 2 and 3) on a bottom surface. As mentioned earlier, the bank frame 128 is attached to the base 116 via the caster pin 124, which hitches the bank frame 128 to the vehicle 104. Specifically, the caster pin 124 is attached to the plate 148 via gussets 160. The gussets 160 also support a plurality of suspension mounts 164. Further, a cylinder mount 166 (FIG. 5) extends from the bottom surface of the plate 148 for attachment to the hydraulic actuator 142.

Figure 5:
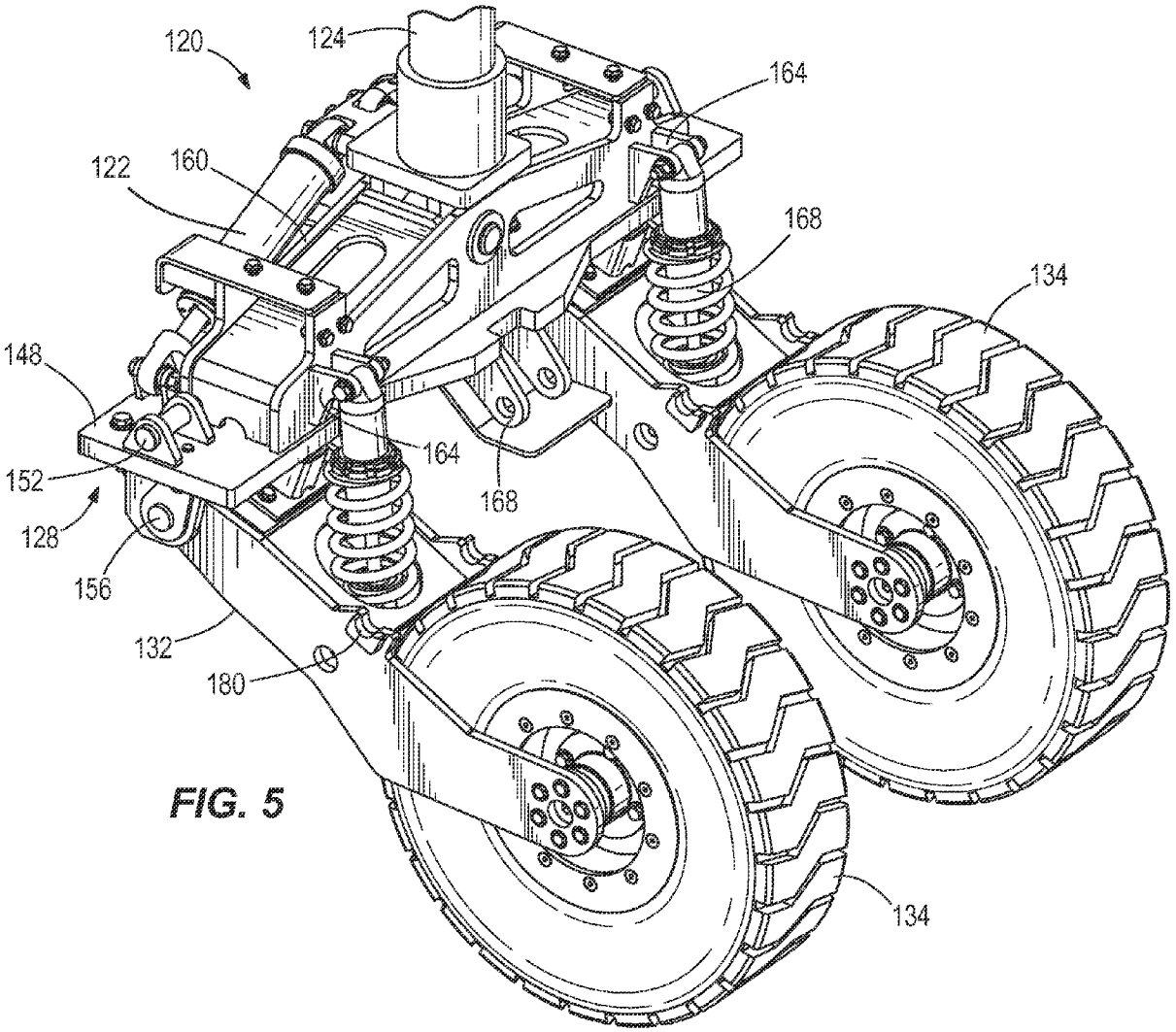
FIG. 5 is a perspective view of a portion of the bank assembly of FIG. 2 illustrating the trailing arms.

FIGS. 3 and 5 illustrate the trailing arms 132 of the bank assembly 120. The trailing arms 132 have a first end supporting the attached wheels 134 for rotational movement and a second end that is pivotally attached to the bank frame 128 at the trailing arm mounts 156. The trailing arms 132, including the wheels 134, are also connected to the bank frame 128 through multiple suspension units 168 to further support the bank frame 128 and for permitting vertical travel of the wheels 134 with respect to the bank frame 128 in response to rough terrain. As the bank assembly 120 encounters rough terrain, the trailing arms 132 are able to pivot relative to the bank frame 128 about the mounts 156 when a force exerted on the wheels 134 overcomes the biasing force of the suspension units 168. The suspension units 168 include various energy absorbing features (e.g., a spring, viscous fluid, etc.) that enable the suspension units 168 to help dissipate the force exerted on the wheels 134 as a result of the rough terrain.

In reference to FIG. 2, the blade plate 136 includes a plurality of attachment arms 172 extending toward the bank frame 128. The attachment arms 172 pivotally connect the blade plate 136 to the blade plate pivot mounts 152 of the bank frame 128. The blade plate 136 is then connected to the hydraulic actuator 142 by a pair of mounting tabs 176 so that the blade plate 136 is raised when the hydraulic actuator 142 is extended and the blade plate 136 is lowered when the hydraulic actuator 142 is refracted. The hydraulic actuator 142 is fluidly coupled to the remainder of a hydraulic system by hydraulic lines and actuated by a control panel mounted within the vehicle 104 for manipulation by a user. In reference to FIG. 10, when the hydraulic actuator 142 is fully retracted, and the blade plate 136 is fully lowered or deployed, an engagement bar or portion 232 of the blade plate 136 engages a suspension lockout feature or groove 180 (FIGS. 5 and 10) formed in the trailing arms 132. The engagement of the blade plate 136 with the lockout groove 180 prevents substantially vertical travel of the wheels 134 relative to the bank frame 128. When the blade plate 136 is engaged with the lockout groove 180, a force pathway is created between the wheel 134 and bank frame 128 that is primarily directed through the blade plate 136, and not the suspension units 168. The alternative force pathway prevents the suspension units 168 from compressing, thereby assisting in the wire neutralizing capabilities of the system 100, as will be described below. Although the lockout feature 180 is illustrated as a groove 180, it is to be understood that the lockout feature 180 could be any other structure or feature that is capable of preventing the full use of the suspension units 168. The blade plate 136 additionally includes a plurality of blade station mounting tabs 184, which are used to attach the blade stations 140.

Figure 6:
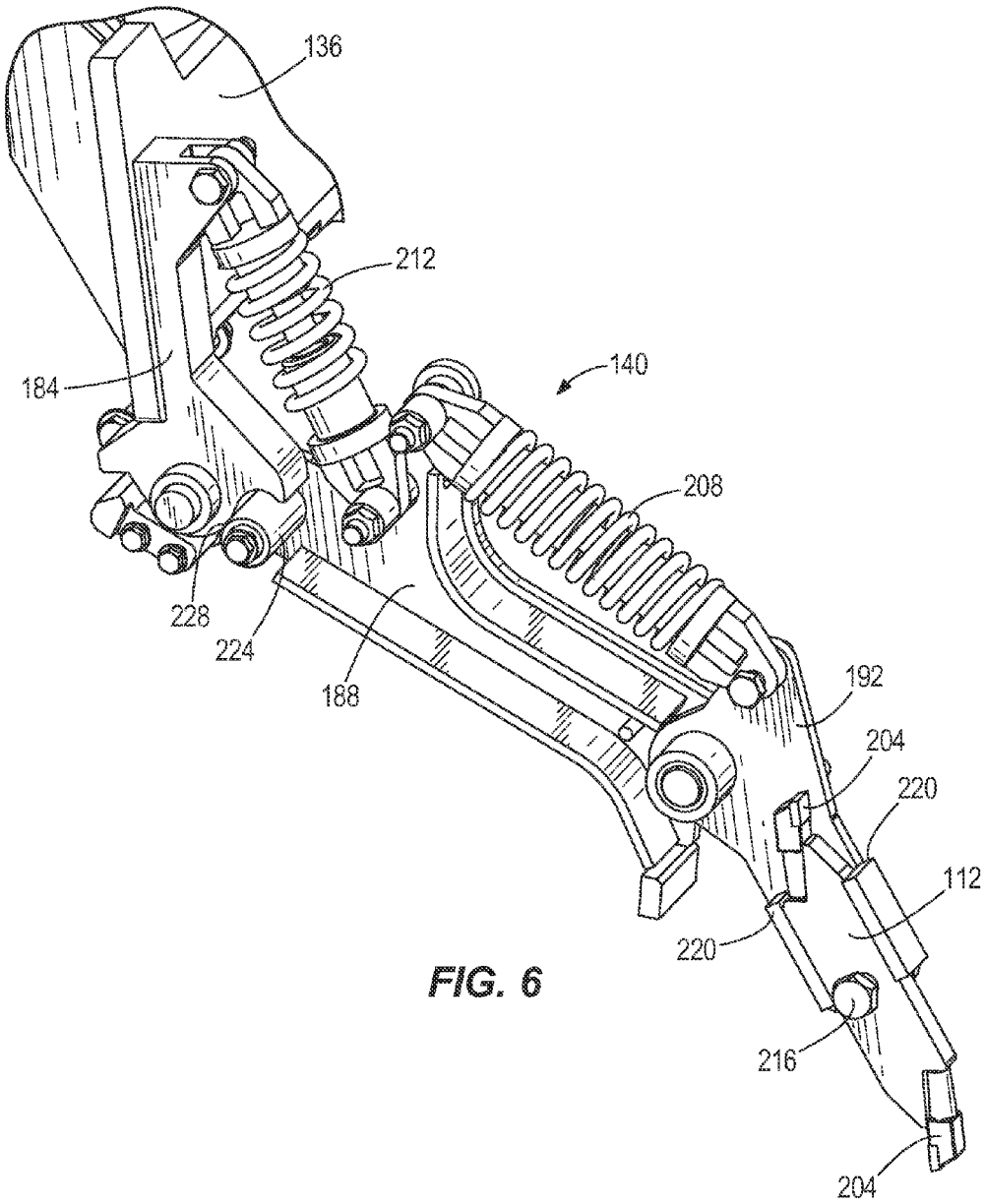
FIG. 6 is a perspective view of a blade station from the bank assembly of FIG. 2

FIG. 6 illustrates a single blade station 140 according to an embodiment of the present invention with portions removed to illustrate various enclosed features. The blade station 140 includes a blade arm 188 pivotally connected to the blade station mounting tab 184 and a blade holder 192 pivotally connected to the blade arm 188. The blade holder 192 supports a blade 112, which extends past the blade holder 192 to expose a cutting edge 204 for insertion into the terrain to neutralize the buried wires 108. The blade station 140 also includes an overload trip biasing member 208 coupled to both the blade holder 192 and the blade arm 188. Additionally, the blade station 140 includes an overload lift biasing member 212 coupled to both the blade arm 188 and the blade station mounting tab 184. The purpose of the biasing members 208, 212 will be described in detail below.

In continued reference to FIG. 6, the blade 112 includes two sets of cutting edges 204 (i.e., first and second cutting edges 204 at opposite ends of the blade 112) such that the blade 112 can be oriented in two positions. The double-edged blade 112 allows the user to change the orientation of the blade 112 between first and second orientations. In the first orientation, the first cutting edge 204 is use while the second cutting edge 204 is in reserve within the blade holder 192. The operator may switch to the second orientation of the blade 112 when the first cutting edge 204 becomes dull or damaged. In the second orientation, the second cutting edge is placed into use and the first cutting edge is in reserve. The cutting edge 204 that is in use extends beyond the blade holder 192 so it can engage and cut through the terrain. While in either the first or second orientation, the position of the blade 112 is fixed relative to the blade holder 192. Specifically, the blade 112 is attached to the blade holder 192 by a mount or fastener 216 while two blocks 220 prevent rotation of the blade 112 about the fastener 216. Further, the cutting edges 204 are made from a carbide material to help prevent excessive wear of the cutting edges 204 and extend the lifetime of the blade 112. Alternatively, or in addition, other types of blades 112 not illustrated (e.g., singled-edged blades, etc.) may be used with the wire neutralization system 100.

Figure 7:
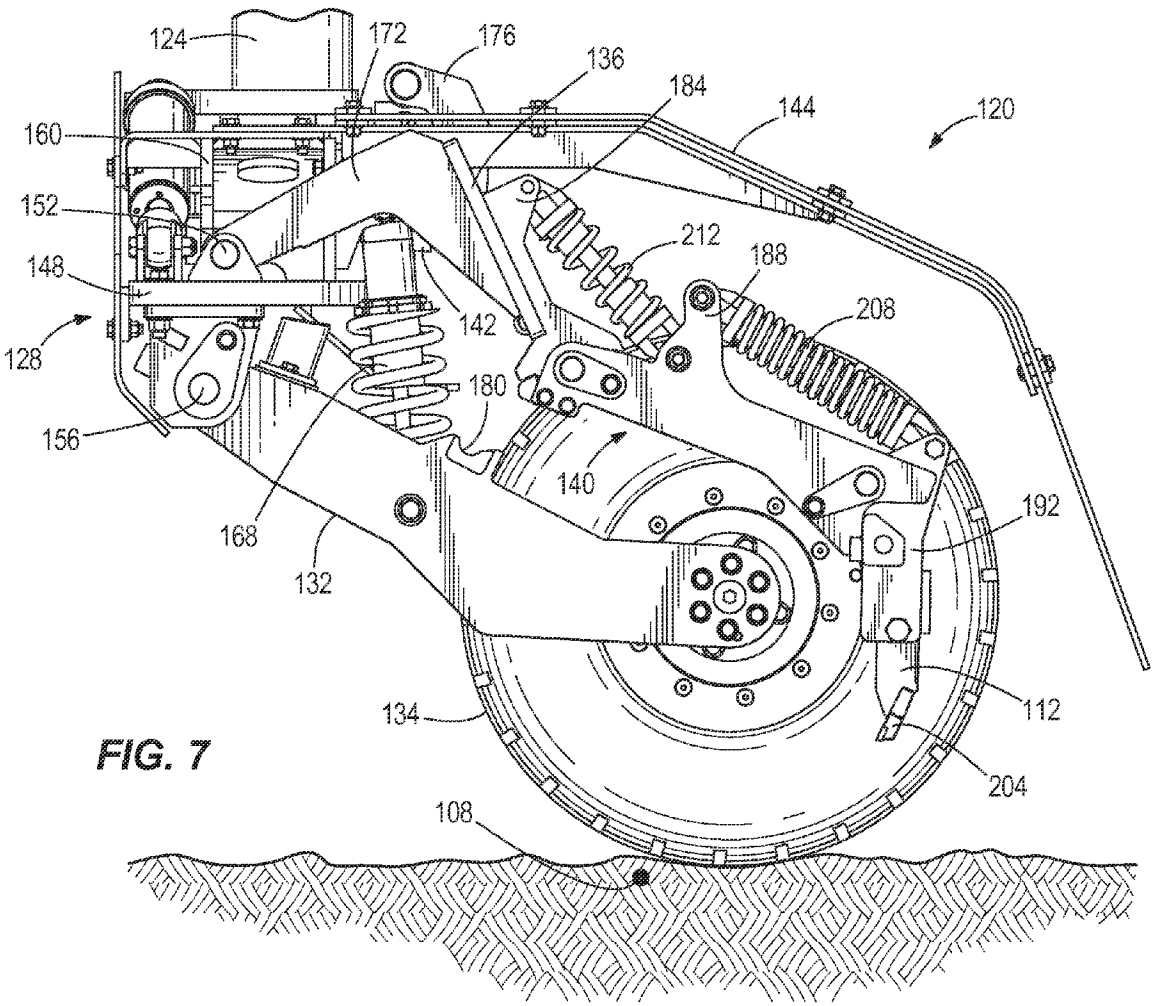
FIG. 7 is a side view of the bank assembly of FIG. 2 with the blade in a stowed position.
Figure 8:
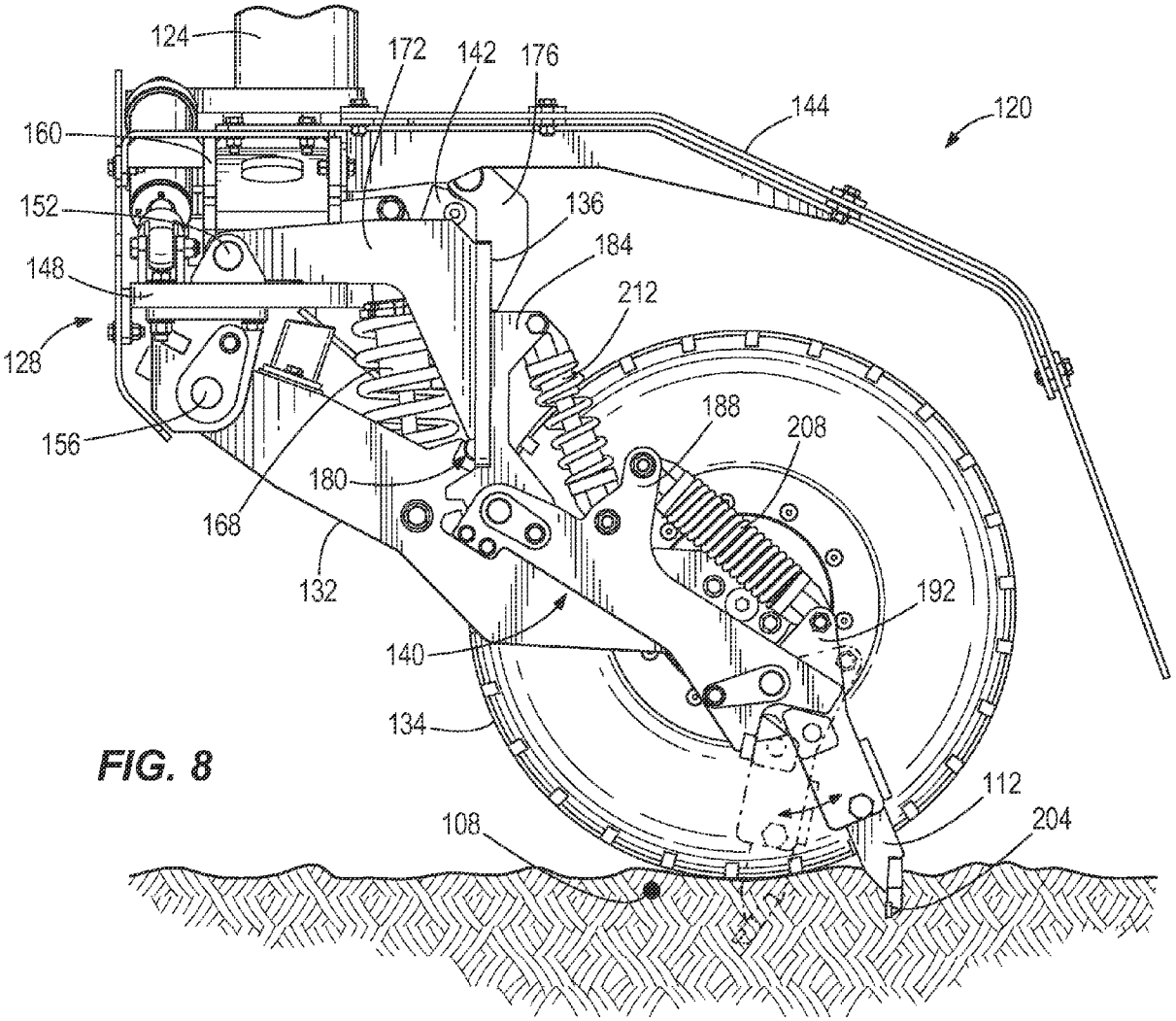
FIG. 8 is a side view of the bank assembly of FIG. 2 with the blade in a deployed position.

FIG. 7 illustrates the wire neutralization system 100 with the blade 112 in a retracted or stowed position. To move the blade 112 into the stowed position, the hydraulic actuator 142 is extended, causing the blade plate 136 and the blade station 140 to be lifted relative to the bank frame 128 so that the blade 112 is above the bottom of the wheel 134. FIG. 8 illustrates the wire neutralization system 100 with the blade 112 in the deployed position. The blade 112 is moved from the stowed position (FIG. 7) into the deployed position (FIG. 8) by retracting the hydraulic actuator 142, which lowers the blade plate 136 and the blade station 140 relative to the bank frame 128. The illustrated wire neutralization system 100 fails into the deployed position because if hydraulic fluid is lost the hydraulic actuator 142 will retract under the weight of the assembly it supports. In other configurations, the wire neutralization system 100 can be made to fail into the stowed position as a matter of design preference.

When the blade station 140 is lowered, a portion of the blade 112, including the cutting edge 204, is inserted into the ground. In the illustrated embodiment, the blade 112 extends below the bottom of the wheel 134 by approximately two inches while in the deployed position. In other embodiment, the blade 112 may extend more or less than two inches below the bottom of the wheel 134. While the blade 112 is extended into the ground and the vehicle 104 is moving, the blade 112 is subjected to drag loads.

As illustrated in FIG. 8, the drag loads cause the blade 112 to pivot relative to the blade arm 188 into an operating position (shown with solid lines) from a non-operating position (shown with phantom lines). During typical operation, the blade 112 and blade holder 192 are pushed back to a position in a range from 90 degrees to 135 degrees in relation to the blade arm 188, depending on the drag load exerted on the blade 112 by the terrain or ground. This may result in a forward sweeping motion of the blade 112 toward the non-operating position when the blade 112 transitions from hard terrain to soft terrain or a hole.

Additionally, the blade 112 may encounter hard objects (e.g., rocks) while it is extended into the ground that may exert a large impact force or resistance on the blade 112. A large impact force may cause damage to the blades 112. Therefore, the plurality of overload biasing members 208, 212 are provided to allow controlled movement of the blade 112 relative to the bank frame 128 during such an impact force. The impact force may have a horizontal force component, or tripping resistance, that causes the blade 112 and blade holder 192 to rotate relative to the blade arm 188 into a tripped position (rotated further than the operating position) causing the overload trip biasing member 208 to compress and absorb some of the impact. After impact, the biasing force of the trip biasing member 208 forces the blade 112 back into the typical deployed or operating position.

Figure 9:
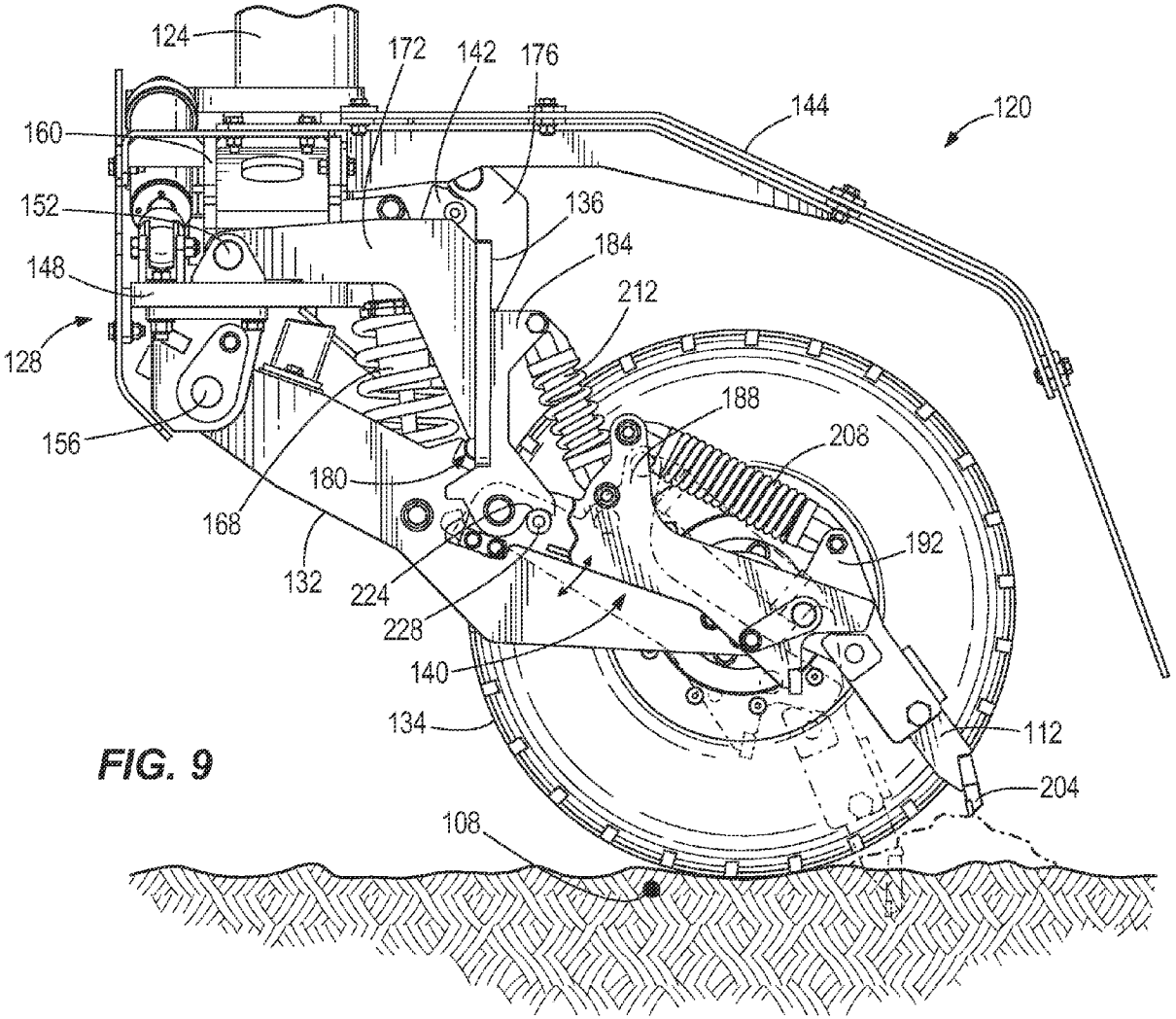
FIG. 9 is a side view of the bank assembly of FIG. 2 with the blade in a lifted position.

Similarly, the impact force caused by a hard or dense objet may have an upward force component, or lifting resistance, on the blade 112. The upward force causes the blade arm 188 to rotate relative to the blade station mounting tab 184 into a lifted position (FIG. 9) causing the overload lift biasing member 212 to compress and absorb some of the impact. The blade arm 188 includes a stop member or cylindrical stop 224 that engages with an arcuate groove 228 formed in the blade station mounting tab 184 to prevent further vertical movement of the blade 112 past the lifted position. After the impact, the biasing force of the lift biasing member 212 forces the blade 112 back into the deployed or operating position. The impact force acting on the blade 112 may also cause both the biasing members 208, 212 to be compressed, allowing the blade 112 to move vertically and horizontally in relation to the bank frame 128.

Figure 10:
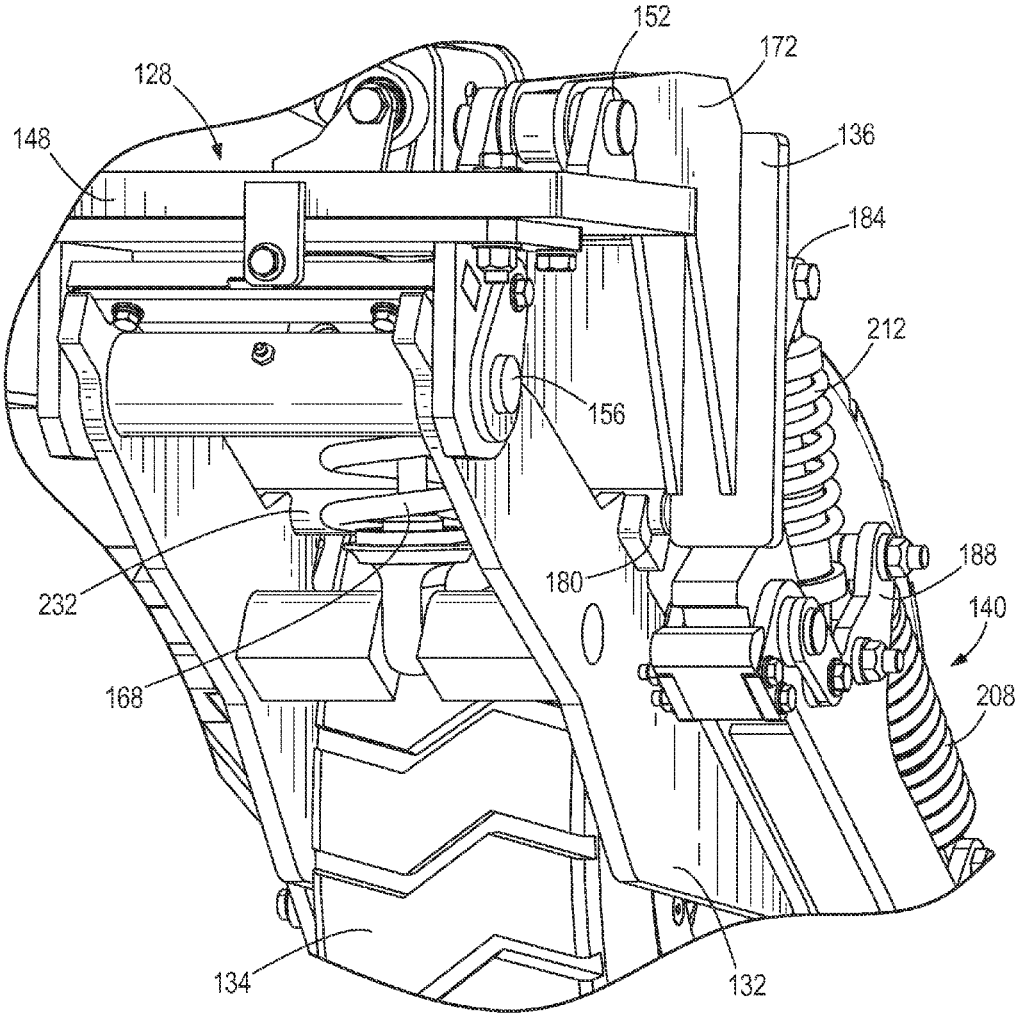
FIG. 10 is a perspective view of a portion of the bank assembly of FIG. 2 illustrating an engagement bar in a lockout groove.

In operation, the blades 112 of the bank assemblies 120 are positioned in the deployed position. While the blades 112 are in the deployed position, the blade plate 136 engages with the lockout groove 180 (i.e., the engagement bar 232 is received by the lockout groove 180) to provide constant engagement of the blades 112 with the ground or terrain, as illustrated in FIG. 10. As such, the suspension units 168 are prohibited from compressing such that wheel 134 will not move vertically relative to the bank frame 128 and the blades 112, keeping the blade 112 deployed at the intended depth, which may be approximately two inches. Once the blades 112 are deployed, the vehicle 104 may drive along a desired route to neutralize wires 108 attached to explosive devices that are buried in the ground. While driving, the blades 112 are able to move relative to the bank frame 128 in response to varied terrain density or in reaction to hard objects, as described above. Once the vehicle 104 has arrived at its destination, and the plowing of terrain is no longer necessary, the blades 112 are lifted into the stowed position, the engagement bar 232 is removed from the lockout groove 180, and the suspension units 168 are operational. While the blades 112 are in the stowed position, the vehicle 104 may drive on any type of road (e.g., paved, gravel, etc.) without causing damage to the road as a result of the blades 112. It is to be understood that the wire neutralization system 100 of the present invention is capable of being pushed, pulled, or moved at high speeds while attached to the vehicle 104. In some embodiment, the wire neutralization system 100 may be driven at a speed in excess of 20 mph (miles per hour). In other embodiments, the system 100 may be driven at a speed in excess of 45 mph. In yet another embodiment, the system 100 may be driven at a speed in excess of 60 mph.

Various features and advantages of the invention are set forth in the following claims.

What is claimed is:

1. A wire neutralizing system for use with a vehicle, the wire neutralization system comprising:

a frame adapted to be hitched to the vehicle;

at least one wheel supporting the frame, a bottom of the wheel rolling over terrain having buried wires;

a blade plate movably mounted to the frame;

a blade station attached to the blade plate including:

a blade arm mounted to the blade plate;

a blade holder mounted to the blade arm; and a blade supported by the blade holder;

wherein the blade is movable between a stowed position in which the blade is above the bottom of the wheel and a deployed position in which the blade is below the bottom of the wheel by moving the blade plate with respect to the frame;

a wheel suspension unit permitting vertical travel of the wheel with respect to the frame in response to rough terrain while the blade is in the stowed position; and a suspension lockout feature that prevents relative vertical travel of the wheel with respect to the frame while the blade is in the deployed position;

wherein the blade plows through the terrain to disable the buried wires when in the deployed position, and wherein the wheel is engaged with the terrain while the blade plows through the terrain in the deployed position.

2. The wire neutralization system of claim 1, wherein the suspension lockout feature includes a lockout engagement groove, the lockout engagement groove engageable by the blade plate such that a force pathway is created between the wheel and the frame through the blade plate.

3. The wire neutralization system of claim 2, wherein the wheel is supported by a trailing arm, wherein the lockout engagement groove is disposed on the trailing arm, and wherein the force pathway is created between the wheel and the frame through the blade plate when the blade is in the deployed position.

4. The wire neutralization system of claim 3, wherein the blade plate includes an engagement bar, and wherein the engagement bar is received in the lockout engagement groove when the blade is in the deployed position.

5. The wire neutralization system of claim 1, wherein the blade plate is movable relative to the frame via a hydraulic system.

6. The wire neutralization system of claim 1, wherein the blade plate is pivotably interconnected to the frame and the blade arm is pivotably interconnected to the blade plate such that the blade moves between the stowed and deployed positions in response to the blade plate being pivoted relative to the frame.

7. The wire neutralization system of claim 1, wherein the blade plate includes a blade station mounting tab to mount the blade station to the blade plate.

8. The wire neutralization system of claim 7, further comprising a blade lift biasing member connected to the blade station mounting tab and the blade arm to bias the blade toward the deployed position and accommodating movement of the blade toward a lifted position upon the blade meeting a lifting resistance while in the deployed position.

9. The wire neutralization system of claim 8, wherein the blade arm includes a stop member that engages a portion of the blade station mounting tab to prevent further movement of the blade while in the lifted position.

10. The wire neutralization system of claim 1, further comprising a blade trip biasing member connected to the blade holder and the blade arm to bias the blade toward the deployed position and accommodating movement of the blade toward a tripped position upon the blade meeting a tripping resistance while in the deployed position.

* * * * *